United States Patent [19]

Schlack et al.

[11] Patent Number: 4,782,263

[45] Date of Patent: Nov. 1, 1988

[54] INLINE ELECTRON GUN HAVING AT LEAST ONE MODIFIED CATHODE ASSEMBLY

[75] Inventors: Richard E. Schlack, Lower Winsor Township, York County; Stephen T. Opresko, Lancaster, both of Pa.

[73] Assignee: RCA Licensing Corporation, Princeton, N.J.

[21] Appl. No.: 612,429

[22] Filed: May 21, 1984

[51] Int. Cl.[4] ..... H01J 29/02

[52] U.S. Cl. ..... 313/409; 313/447; 313/417; 313/270; 313/345; 313/337

[58] Field of Search ..... 313/337, 270, 446, 409, 313/417, 447, 345

[56] References Cited

U.S. PATENT DOCUMENTS

| | | | |
|---|---|---|---|
| 3,569,768 | 3/1971 | Benda | 313/270 |
| 3,772,554 | 11/1973 | Hughes | 313/69 C |
| 3,974,414 | 8/1976 | Buescher et al. | 313/331 |
| 4,000,435 | 12/1976 | Jariwala | 313/446 |
| 4,063,128 | 12/1977 | Hughes | 313/409 |

FOREIGN PATENT DOCUMENTS

| | | | |
|---|---|---|---|
| 0119662 | 10/1978 | Japan | 313/337 |
| 0104280 | 8/1979 | Japan | 313/337 |

OTHER PUBLICATIONS

U.S. patent application Ser. No. 556,184, filed by R. E. Schlack on Nov. 29, 1983, entitled, "Cathode-Ray Tube Having an Electron Gun Assembly with Emissivity Modifying Means".

U.S. Published Pat. Application No. B393,970 issued on Jan. 28, 1975 to Floyd K. Collins, et al., titled "Carbide Structure for Cathode Ray Tube."

*Primary Examiner*—David K. Moore

*Assistant Examiner*—Michael Razavi

*Attorney, Agent, or Firm*—Eugene M. Whitacre; Dennis H. Irlbeck; Vincent J. Coughlin, Jr.

[57] ABSTRACT

An inline electron gun for a cathode-ray tube has three cathode assemblies each including a cathode sleeve having a cathode cap closing one end of the sleeve and extending therealong. Each cap has an electron emissive coating thereon and a heater is disposed within each sleeve. The center cathode assembly has a laminated bimetal cathode cap comprising a first layer integral with the sleeve and an overlying second layer with a sidewall portion that is shorter than the sidewall portions of the two outer cathode caps of the outer cathode assemblies. The center cap thus has less thermal mass than the outer caps and the center cathode assembly therefore reaches electron emission temperature before the outer cathode assemblies.

8 Claims, 2 Drawing Sheets

INLINE ELECTRON GUN HAVING AT LEAST ONE MODIFIED CATHODE ASSEMBLY

BACKGROUND OF THE INVENTION

The invention relates to inline electron guns for cathode ray tubes and, more particularly, to an inline electron gun having a plurality of cathode assemblies, at least one of which is modified to have a turn-on time different from that of the other cathode assemblies.

A typical cathode-ray tube, e.g., a color television picture tube, includes an electron gun comprising three substantially identical cathode assemblies, each of which generates and focuses an electron beam which impinges on a different color phosphor element disposed on an interior surface of the tube faceplate. In a conventional tube, the phosphor elements are red-, green-, and blue-emitting stripes or dots, which are stimulated to emission by the aforementioned electron gun assembly. The cathode assembly that provides an electron beam which impinges on the red-emitting phosphor element will be hereinafter referred to as the red gun. The same convention will also apply to the green gun and the blue gun.

In a television receiver, it is desirable that when the receiver is switched on, the picture appears quickly and with the proper colors. This capability is directly related to the rate of increase in electron gun cathode temperature. Some receiver manufacturers require that the initial screen color (with no video signal) be either white or green, rather than red, blue or purple. A white screen indicates equal color balance between the red, green and blue guns. A green color indicates that the cathode of the green gun has reached emission temperature before the cathodes of the red or blue guns.

In the prior art, it was known to preheat the cathode heater to meet the demand of quick turn-on. However, even a quick turn-on system does not always provide a white or green initial screen color. Furthermore, the preheated cathodes use power when the television receiver is out of use. Such a structure is energy inefficient.

A portion of a conventional inline electron gun such as that described in U.S. Pat. No. 3,772,554 issued to R. H. Hughes on Nov. 13, 1974 is shown in FIG. 1. The electron gun includes three substantially identical cathode assemblies and a plurality of spaced electrodes attached to a pair of glass support rods. Each of the cathode assemblies comprise a tubular cathode sleeve open at one end to accommodate a heater and closed at the other end by a cap having an electron emissive coating thereon. A cathode eyelet is attached to the open end of the cathode sleeve.

U.S. patent application Ser. No. 556,184, by R. E. Schlack filed on Nov. 29, 1983, assigned to the assignee of the present invention and incorporated by reference herein for the purpose of disclosure, describes an electron gun in which the emissivity of one or more of the cathode eyelets is modified to change the radiant emission characteristics thereof to cause the center cathode assembly (green gun) to reach emission temperature before the outer cathode assemblies (red and blue guns). In a test conducted using the eyelet structure described in the Schlack patent application, four of six tubes utilizing the modified eyelet structure showed initial green emission. The fact that two tubes did not was explained by uncontrolled changes in other parameters such as heater filament resistance, heater filament insertion variations in the cathode sleeve, unequal thermal changes or electron emissive material thickness variations of the cathode coating. A more reliable structure which provides initial green emission is desirable.

SUMMARY OF THE INVENTION

An inline electron gun for a cathode-ray tube has a plurality of cathode assemblies each including a cathode sleeve having a cathode cap closing one end of the sleeve and extending longitudinally therealong. Each cap has an electron emissive coating thereon. A heater is disposed within each sleeve. At least one of the cathode assemblies includes a bimetal cathode cap integral with said sleeve, said cap having a length different from the length of the other cathode caps whereby the turn-on time of the at least one cathode assembly is different from that of the other cathode assemblies.

DETAILED DESCRIPTION OF THE PREFERRED EMBODIMENT

Figure 1:
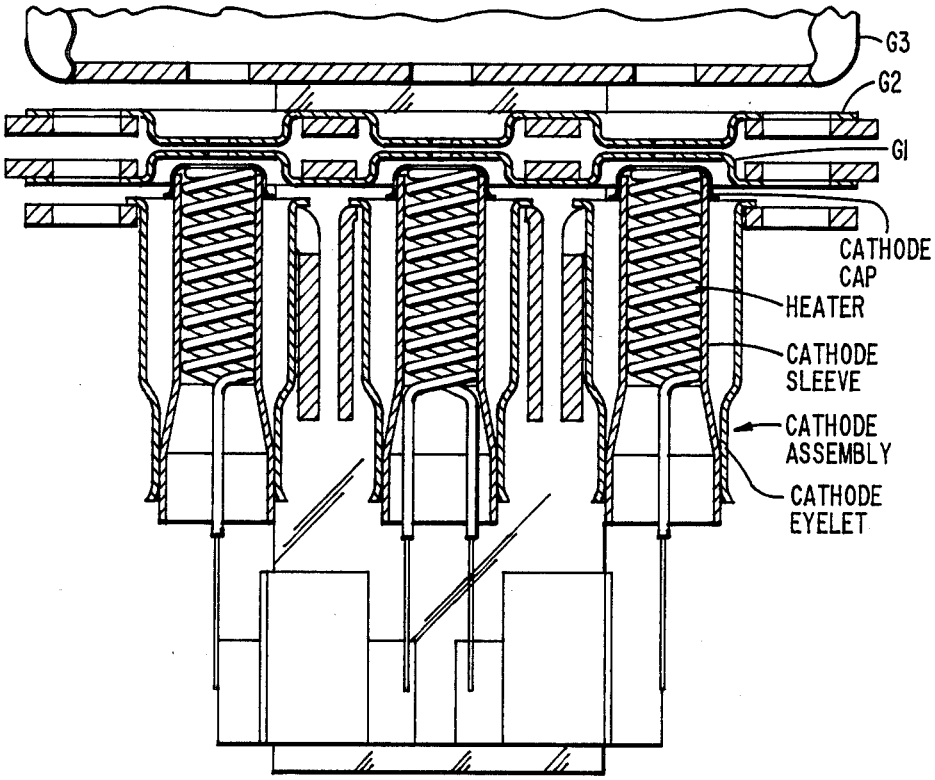
Fig. 1 PRIOR ART
FIG. 1 is a sectional view of a portion of an inline electron gun having conventional cathode assemblies.
Figure 2:
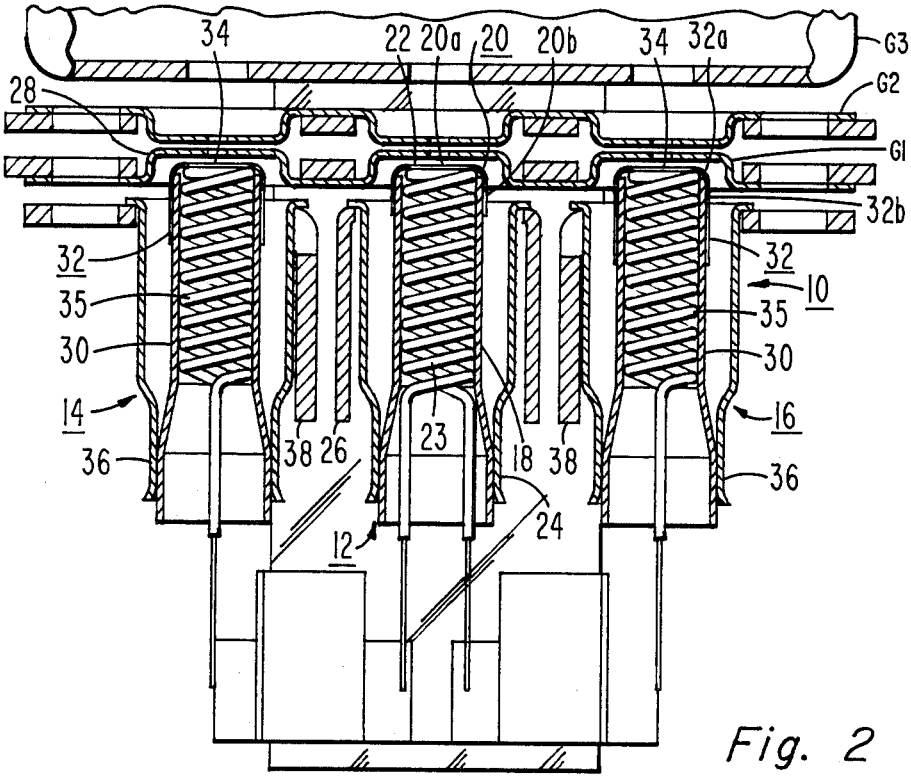
FIG. 2 is a sectional view of a portion of a novel inline electron gun embodying the present invention.
Figure 3:
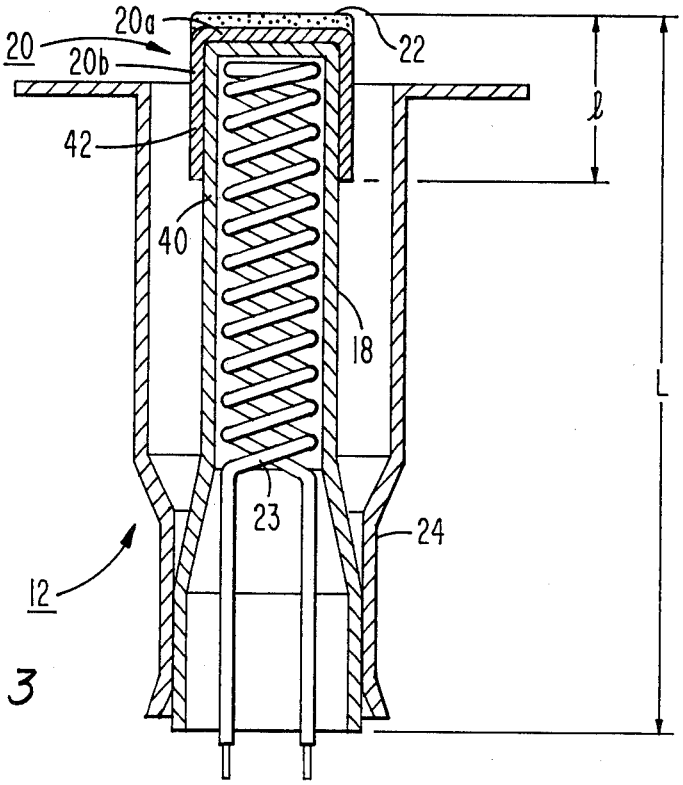
FIG. 3 is an enlarged sectional veiw of a cathode assembly according to the present invention.

In FIG. 2, there is shown a portion of a novel electron gun assembly 10 of a type used in color television picture tubes. The novel electron gun assembly 10 comprises three coplanar cathode assemblies including a center cathode assembly 12 (the green gun), a first outer cathode assembly 14 (the red gun), and a second outer cathode assembly 16 (the blue gun) for generating three electron beams toward a screen (not shown) of the tube. The center cathode assembly 12 comprises a tubular cathode sleeve 18 having a cathode cap 20 closing one end of the sleeve 18. The center cathode cap 20 is preferably integral with the sleeve, as described hereinafter, and includes a transverse portion **20*a* which extends across and closes the one end of the sleeve 18 and a wall portion 20*b* which extends longitudinally along the sleeve 18. As shown in FIG. 3, the wall portion 20*b* has a length, l, of at least 0.635 mm and the overall length, L, of the sleeve 18, including the transverse portion 20*a* of the cap 20, is about 8.76 mm. An end coating 22 of an electron emissive material is disposed on the transverse portion 20*a* of the cathode cap 20. A heater filament 23 is mounted within the cathode sleeve 18 and spaced therefrom. As shown in FIG. 2, the electron emissive coating 22 is supported at a predetermined spacing from the first grid 28 (also referred to as the control grid, G1) by a center cathode eyelet 24, which coaxially surrounds at least a portion of the cathode sleeve 18. The eyelet 24 has an interior surface and an exterior surface with the oppositely disposed open end of the cathode sleeve 18 being attached, for example, by welding, to the interior surface of the eyelet 24. A center cathode support 26 is attached, also by welding, to the exterior surface of the forward end of the center eyelet 24**.

Similarly, the first and second outer cathode assemblies 14 and 16 each comprise a cathode sleeve 30 having an outer end cap 32 closing one end of the sleeve 30. Each of the outer cathode caps 32 is preferably integral with the sleeve 30 and includes a transverse portion **32*a* which extends across and closes the one end of the sleeve 30 and a wall portion 32***b* which extends longitudinally along the sleeve 30. The length of the wall portion 32*b* is within the range of about 1.27 mm to 2.54 mm and is at least 0.635 mm longer than the length of the sidewall portion 20*b* of the center cathode cap 20. The overall length of the sleeve 30, including the transverse portion 32*a* of the cap 32, is about 8.76 mm. An end coating 34 of an electron emissive material is disposed on the transverse portion 32*a* of the cathode cap 32. A heater filament 35 is mounted within each cathode sleeve 30 and spaced therefrom. The electron emissive coatings 34 are each maintained at a predetermined spacing from the first grid 28 by a cathode eyelet 36, which coaxially surrounds at least a portion of the cathode sleeve 30. The eyelet 36 has an interior surface and an exterior surface with the oppositely disposed open end of the cathode sleeve 30 being attached, for example, by welding, to the interior surface of the eyelet 36. An outer cathode support 38 is attached, also by welding, to the exterior surface of the forward end of the outer eyelets 36.

The center cathode assembly 12 (the green gun) is shown in enlarged detail in FIG. 3. The center cathode assembly 12 is similar to the outer cathode assemblies 14 and 16 and varies from the outer cathode assemblies 14, 16 only in that the length of the sidewall portion 20*b* of center cathode cap 30 is shorter than the sidewall portions 32*b* of the outer cathode caps 32.

The center cathode sleeve 18 and integral cap 20. are formed from a laminated bimetal member which includes a first layer 40, preferably of Nichrome, having a thickness of about 0.028 mm and a second layer 42, preferably of bright nickel having a thickness of about 0.048 mm. The bimetal member is deep drawn into the form of a closed end cylinder (not shown) with the first layer 40 forming the interior portion and the second layer 42 forming the exterior portion of the cylinder. The closed end of the cylinder and a portion of the sidewall is masked by an etch fixture (not shown) and the cylinder is etched in a mixture of acetic acid and nitric acid to selectively remove the second layer 42 from a portion of the cylinder. The etched structure comprises the sleeve 18 and the integral bimetal cap 20 of the center cathode assembly 12. In the preferred embodiment the etch fixture is adjusted to provide a center cap sidewall 20*b* having a length of about 1.27 mm. The outer cathode sleeve 30 and integral cap 32 are formed in the same manner as described herein except that the etching fixture is adjusted to provide an outer cap sidewall 32*b* having a length of about 2.54 mm. The shorter length of the sidewall portion 20*b* of the center cathode cap 20 provides a reduced thermal mass relative to that of the longer sidewall portions 32*b* of the outer cathode caps 32. The reduction in thermal mass of the center cathode cap permits the center cathode assembly 12 (the green gun) to reach electron emission temperature before the outer cathode assemblies 14 and 16, thus providing an initial green screen color with no video signal.

A number of tests were performed on color television picture tubes having cathode caps of various lengths. In each series of tests the cathode cap of the center cathode assembly (the green gun) was shorter than the cathode caps of the outer cathode assemblies (the red and blue guns). In each test the center cathode assembly was the first to emit. The test parameters were determined by operating all cathode assemblies and the control grid (G1) 28 at ground potential. The time, in seconds, from heater turn-on until 50 μA emission occurred was measured and recorded. In the first test, summarized in Table I, the center cap 20 had a sidewall length 20*b* of 1.27 mm and the outer caps 32 had a sidewall length of 2.54 mm. Of the six tubes tested, the average turn-on time for the center cathode assembly 12 (green gun) was 7.7 seconds, the average turn-on time for the first outer cathode assembly 14 (red gun) was 9.09 seconds, and the average turn-on time for the second outer cathode assembly 16 (blue gun) was 9.05 seconds.

TABLE I

| Tube No. | Red Gun (sec.) | Green Gun (sec.) | Blue Gun (sec.) |
|---|---|---|---|
| 1103 | 9.53 | 7.35 | 8.18 |
| 1104 | 8.83 | 7.08 | 9.95 |
| 1102 | 9.95 | 8.50 | 8.70 |
| 1109 | 8.18 | 7.48 | 8.18 |
| 1107 | 9.18 | 7.78 | 9.40 |
| 1101 | 8.88 | 8.03 | 9.90 |
| Avg. | 9.09 | 7.70 | 9.05 |

The results of the second test are summarized in TABLE II. The center cathode cap 20 had a sidewall portion 20*b* with a length of 0.635 mm and the outer cathode cap 32 had sidewall portions 32*b* with a length of 1.27 mm. The average turn-on time for the center cathode assembly 12 (green gun) was 6.82 seconds; the average turn-on time for the first outer cathode assembly 14 (red gun) was 7.66 seconds and the average turn-on time for the second outer cathode assembly 16 (blue gun) was 7.36 seconds.

TABLE II

| Tube No. | Red Gun (sec.) | Green Gun (sec.) | Blue Gun (sec.) |
|---|---|---|---|
| 1302 | 7.40 | 6.78 | 7.60 |
| 1305 | 7.63 | 6.90 | 7.10 |
| 1306 | 7.88 | 7.08 | 7.50 |
| 1303 | 7.73 | 6.53 | 7.23 |
| Avg. | 7.66 | 6.82 | 7.36 |

The results of the third test are summarized in TABLE III. The center cathode cap 20 had a sidewall portion 20*b* with a length of 1.27 mm and the outer cathode caps 32 had sidewall portions 32*b* with a length of 1.81 mm. The average turn-on time for the center cathode assembly 12 (green gun) was 7.78 seconds; the average turn-on time for the first outer cathode assembly 14 (red gun) was 9.13 seconds and the average turn-on time for the second outer cathode assembly 16 (blue gun) was 8.68 seconds.

TABLE III

| Tube No. | Red Gun (sec.) | Green Gun (sec.) | Blue Gun (sec.) |
|---|---|---|---|
| 1316 | 8.30 | 7.50 | 8.47 |
| 1314 | 9.68 | 7.30 | 7.85 |
| 1317 | 8.85 | 7.70 | 9.40 |
| 1313 | 9.70 | 8.60 | 9.00 |
| Avg. | 9.13 | 7.78 | 8.68 |

The results of the fourth test are summarized in TABLE IV. The center cathode cap 20 had a sidewall portion 20*b* with a length of 0.635 mm and the outer cathode caps 32 had sidewall portions 32*b* with a length of 1.81 mm. The average turn-on time for the center cathode assembly 12 (green gun) was 6.75 seconds; the average turn-on time for the first outer cathode assembly 14 (red gun) was 8.25 seconds and the average turn-on time for the second outer cathode assembly 16 (blue gun) was 8.39 seconds.

TABLE IV

| Tube No. | Red Gun (sec.) | Green Gun (sec.) | Blue Gun (sec.) |
|---|---|---|---|
| 1308 | 8.00 | 6.38 | 8.00 |
| 1311 | 8.70 | 6.93 | 9.15 |
| 1312 | 8.05 | 6.95 | 8.03 |
| Avg. | 8.25 | 6.75 | 8.39 |

The structure described herein provides an initial green screen color with no video signal input. It should be clear to one skilled in the art that other initial screen colors or combinations of colors can be achieved by modifying other cathode caps in the manner of the present invention.

What is claimed is:

1. In an inline electron gun for a cathode-ray tube having a plurality of cathode assemblies each comprising a cathode sleeve having a cathode cap closing one end of said sleeve and extending longitudinally along said sleeve, said cap having an electron emissive coating thereon, and a heater disposed within said sleeve, the improvement comprising at least one of said cathode assemblies including a bimetal cathode cap integral with said sleeve, said cap having a length different from the length of the other cathode caps whereby the turn-on time of said at least one cathode assembly is different from that of the other cathode assemblies.

2. In an inline electron gun for a cathode-ray tube having three cathode assemblies each comprising a cathode sleeve being open at one end and closed at the other end, the closed end including a cathode cap having a transverse portion and a wall portion extending longitudinally along said sleeve, said transverse portion having an electron emissive coating thereon, and a heater disposed within said sleeve and spaced therefrom, the improvement wherein at least one of said cathode assemblies having a laminated bimetal cathode cap, said cap comprising a first layer integral with said sleeve and an overlying second layer with a wall portion having a length different from the length of the wall portions of the cathode caps of the other cathode assemblies whereby the turn-on time of said at least one cathode assembly is different from that of the other cathode assemblies.

3. The electron gun as described in claim 2, wherein said laminated bimetal cathode cap with said wall portion formed of said overlying second layer has a length less than that of the wall portions of the cathode caps of the other cathode assemblies.

4. The electron gun as described in claim 3, wherein said at least one cathode assembly is the center cathode assembly of said three cathode assemblies.

5. The electron gun as described in claim 4, wherein said wall portion of said laminated bimetal cathode cap of said center cathode assembly is at least 0.635 mm long.

6. The electron gun as described in claim 5, wherein said wall portion of said laminated bimetal cathode cap of said center cathode assembly is at least 0.635 mm shorter than the wall portions of said cathode caps of the other cathode assemblies.

7. The electron gun as described in claim 6, wherein the wall portions of the other cathode caps have a length not greater than about 2.54 mm.

8. In an inline electron gun for a cathode-ray tube comprising three coplanar cathode assemblies for generating three electron beams toward a screen of said tube, said cathode assemblies including a center cathode assembly and two outer cathode assemblies, each of said cathode assemblies including a tubular sleeve and an integral cathode cap, said cathode cap including a transverse portion extending across and closing one end of said tubular sleeve and a wall portion extending longitudinally along said sleeve for a distance less than the length of said sleeve, an electron emissive coating disposed on said transverse portion of said cathode cap, a heater disposed within said sleeve, and a cathode eyelet supporting said cathode sleeve, the improvement comprising said integral cathode cap of said center cathode assembly being formed of a laminated bimetal having a first layer with said sleeve and an overlying second layer having a wall portion with a length less than the length of the wall portions of said cathode caps of said outer cathode assemblies, whereby the thermal mass of said cathode cap of said center cathode assembly being reduced relative to that of said cathode caps of said outer cathode assemblies thereby providing a more rapid electron emission from said center cathode assembly.

* * * * *

UNITED STATES PATENT AND TRADEMARK OFFICE

CERTIFICATE OF CORRECTION

PATENT NO. : 4,782,263

DATED : November 1, 1988

INVENTOR(S) : Richard E. Schlack et al.

It is certified that error appears in the above-identified patent and that said Letters Patent is hereby corrected as shown below:

Column 6, line 43, after "layer" should be --integral--.

Signed and Sealed this

Eighteenth Day of April, 1989

*Attest:*

DONALD J. QUIGG

*Attesting Officer*

*Commissioner of Patents and Trademarks*